United States Patent [19]

Wiand

[11] 4,288,233

[45] Sep. 8, 1981

[54] ABRASIVE PADS FOR LENS LAPPING TOOLS

[76] Inventor: Ronald C. Wiand, 1790 Washington, Birmingham, Mich. 48009

[21] Appl. No.: 63,104

[22] Filed: Aug. 2, 1979

Related U.S. Application Data

[63] Continuation of Ser. No. 872,334, Jan. 25, 1978, abandoned.

[51] Int. Cl.[3] ..... B24D 11/00

[52] U.S. Cl. ..... 51/295; 51/395; 51/DIG. 34

[58] Field of Search ..... 51/209 R, 209 DL, 284 R, 51/295, 309, 394, 395, 401, 402, 403, 404, 405, 406, 407, DIG. 34; 125/15

[56] References Cited

U.S. PATENT DOCUMENTS

| | | | |
|---|---|---|---|
| 2,375,263 | 5/1945 | Upper | 51/404 X |
| 2,705,194 | 3/1955 | St. Clair | 51/309 X |
| 2,752,738 | 7/1956 | Seifert | 51/284 X |
| 3,398,442 | 8/1968 | Palmer | 204/27 X |
| 3,626,921 | 12/1971 | Lane | 125/15 |
| 3,869,263 | 3/1975 | Greenspan | 51/209 R |
| 4,010,583 | 3/1977 | Highberg | 51/284 |
| 4,047,902 | 9/1977 | Wiand | 51/209 R X |
| 4,079,552 | 3/1978 | Fletcher | 51/295 |
| 4,086,068 | 4/1978 | Hedin | 51/DIG. 34 |
| 4,114,322 | 9/1978 | Greenspan | 51/209 R X |

*Primary Examiner*—Gary L. Smith
*Assistant Examiner*—Robert P. Olszewski
*Attorney, Agent, or Firm*—Harness, Dickey & Pierce

[57] ABSTRACT

A method for making replaceable abrasive pads for ophthalmic lens lapping tools wherein a substrate sheet is metal plated with abrasive particles and then shapes suitable for lens lapping tools are cut therefrom. The abrasive pads are suitable for abrading glass or plastic lenses.

10 Claims, 4 Drawing Figures

ABRASIVE PADS FOR LENS LAPPING TOOLS

This is a continuation of application Ser. No. 872,334, filed Jan. 25, 1978, now abandoned.

BACKGROUND AND SUMMARY OF THE INVENTION

The present invention relates to replaceable abrasive pads for ophthalmic lens lapping tools used for fine grinding of glass or plastic lenses.

Generally speaking, optical lens surfacing is conventionally carried out by first grinding an approximate curve into the lens by means of a grinding wheel on a curve generator. Then the exact optical curvature of the lens is abraded using a lens lapping tool having a surface characterized by having the optical curvature desired for the lens itself. For glass lenses, the required abrasive is generally provided by continuously feeding a loose abrasive slurry between the lens and the lens lapping tool. This procedure yields a lens with a curve and finish that can be readily polished to achieve a lens of optical quality. For plastic lenses, the abrasive is provided by using a sandpaper pad of the wet or dry type on the surface of the lens lapping tool and grinding lubricant is provided by flowing water between the lens and the sandpaper pad. Both glass and plastic lenses are polished with a velvetine or felt pad on the lens lapping tool using a tin oxide or cerium oxide compound in water as a polishing agent.

Lens lapping tools are relatively expensive because of their precise nature and the requirement of a different lapping tool for each curvature desired in the lens product. Hence, abrasive shims or pads have been developed in the art for use between the lens lapping tool and the lens surface in order that the shim or pad will wear rather than the lens lapping tool itself. Examples of facings or pads for lens grinding tools are disclosed, for example, in U.S. Pat. Nos. 3,144,737, Aug. 18, 1964 to Faas, 3,324,608, June 13, 1967 to Hoenig, 3,522,680, Aug. 4, 1970 to Sarofun, 3,594,963, July 27, 1971 to Beasley, 3,699,721, Oct. 24, 1972 to Beasley, 3,921,344, Nov. 25, 1975 to Goodwin, and 4,019,289, Apr. 26, 1977 to Korrer. U.S. Pat. No. 3,959,935, June, 1, 1976, to Stoppacher discloses an abrasive pad for grinding lenses having an abrasive substance on its surface so that no abrasive slurry must be employed to effect grinding of lens blanks. U.S. Pat. No. 4,047,902, Sept. 13, 1977 to Wiand, discloses a generally useful abrasive product.

Conventional pads, however, wear quickly and must be replaced every cycle, i.e. after each lens is ground, which involves down time on equipment and is generally inconvenient and disruptive to the lens grinding process. Hence, it would be desirable to be able to provide an abrasive pad having a wear resistant, abrasive surface such as is provided by diamond particles metal plated thereon for use in abrading optical lenses. But it has heretofore been thought impractical to use diamond abrasive coated pads for grinding lenses because in previous attempts, they tended to impart scratches to the lens surface. Lapping pads generally have a plurality of radially extending channels cut through the area of the pad so that the pad can conform to the surface of the lens lapping tool. It is believed that during the metal plating of the diamond abrasive particles on the surface of the lapping pad, a significant degree of build-up or "over-plating" occurs along the perimeter of the pad surface. The plurality of radially extending channels cut in the pad and required in order for the pad to conform to the curved surface of the lens lapping tool have the effect of greatly increasing the length of perimeter edges subject to overplating and hence the tendency of the pad to scratch the lens surface.

Thus, it is an object of the present invention to provide a method of making an ophthalmic lens lapping pad which does not require an abrasive slurry during use and which is characterized by having an abrasive surface of diamond particles metal plated thereon. It is another object of this invention to provide a diamond-coated lens lapping pad which can be used to abrade a lens blank without imparting scratches thereto. It is a further object of the present invention to provide a lens lapping pad which has a long life in service and is more economical to use than conventional pads.

These and other objects will be apparent from the following disclosure of the present invention which involves first metal plating diamond abrasive particles onto a sheet substrate and then cutting lens lapping pads therefrom in shapes adapted to conform to the curved surface of a lens lapping tool.

DESCRIPTION OF THE INVENTION

The method of the present invention involves the metal plating of diamond abrasive particles onto a substrate sheet and the subsequent cutting out from the sheet of shapes suitable for use as abrasive pads for lens lapping tools. By practicing the method of the present invention, as set forth in more detail hereinafter, diamond abrasive lens lapping pads suitable for use in fine abrasion of ophthalmic lenses are provided.

Figure 1:
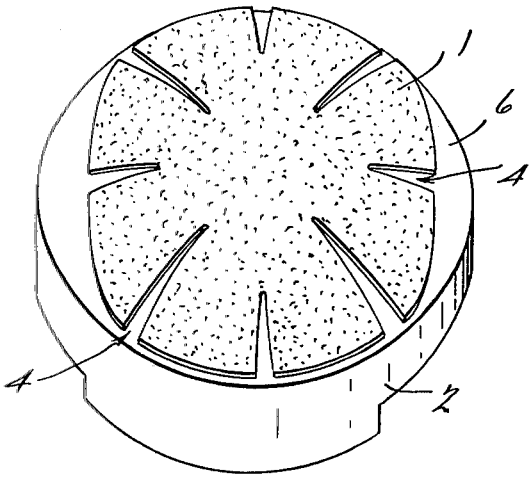
FIG. 1 illustrates, in perspective, a lens lapping pad made in accordance with the present invention in operative location on a lens lapping tool.
Figure 2:
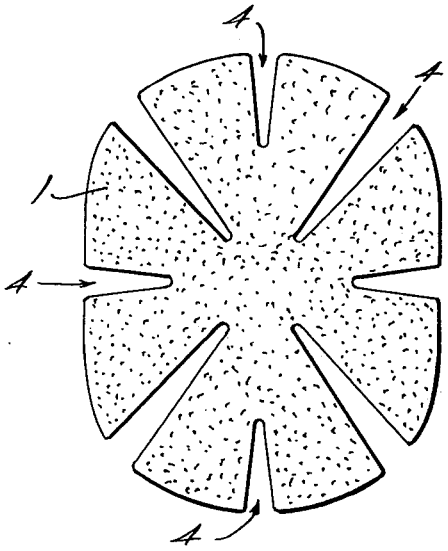
FIG. 2 is a top plan view of a lens lapping pad made in accordance with the present invention.

Now referring to the drawing, FIG. 1 shows a lens lapping pad 1 made in accordance with the present invention and removably attached to a lens lapping tool 2. As shown in FIGS. 1 and 2, pad 1 has a plurality of radially extending channels 4 which enable pad 1 to conform to curved surface 6 of lens lapping tool 2. Of course, it will be apparent to those skilled in the art that the exact location of channels 4 is not critical so long as they facilitate conformity of the pad to the surface of the lens lapping tool. Furthermore, the channels could extend through the pad so that the pad would comprise a series of strips rather than one contiguous unit.

Figure 4:
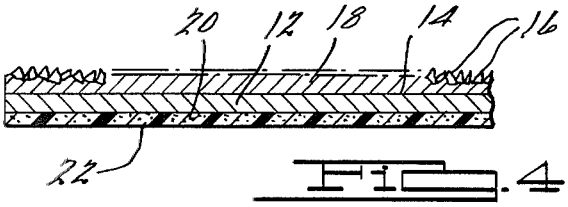
FIG. 4 is a cross-sectional view, taken along the line 4—4 of FIG. 3.
Figure 3:
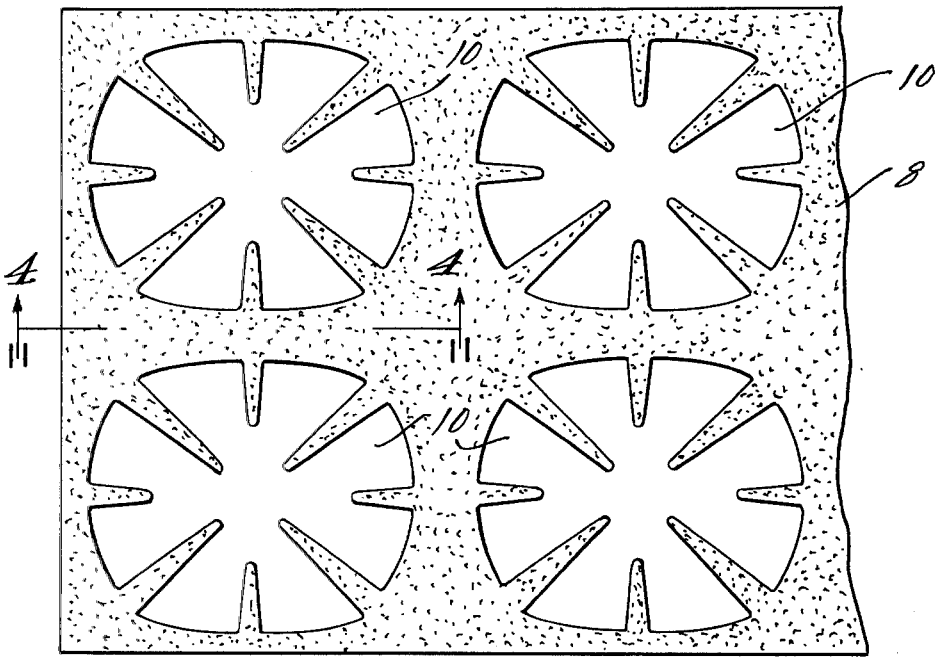
FIG. 3 is a top plan view, broken away, of a diamond-coated, metal plated sheet having a plurality of lens lapping pads removed therefrom.

In accordance with the method of this invention, pads 1 are cut from diamond particle metal plated substrate sheet 8 having holes 10 therein. The composition of sheet 8 is best shown in FIG. 4. A metallic substrate layer 12 has a top surface 14 coated with diamond abrasive particles 16 imbedded in a metallic matrix 18 which has been metal plated onto substrate layer 12. The under surface 20 of substrate 12 is coated with an adhesive layer 22 suitable for removably adhering the pad 1 to lens lapping tool 2. It will be readily apparent to those in the art that adhesive layer 22 can optionally be applied to the surface of tool 2 to adhesively retain pad 1.

Suitable methods of metal plating diamond abrasive particles 16 to substrate layer 12 with metal matrix 18 are known in the art and include electrolytic, chemical reduction and vacuum metal deposition. It has been found preferable, however, to use an electroplating technique with a conduction substrate layer. A most preferred method for metal plating diamond particles 16 is that disclosed in U.S. Pat. No. 4,047,902 which issued Sept. 13, 1977 to Wiand for "Metal-Plated Abrasive Product and Method of Manufacturing the Product" wherein abrasive particles are positioned on a substrate by the use of a special marking technique.

The exact method of cutting the desired pad shape from the diamond-coated sheet is not critical but it is contemplated that in manufacture conventional metal stamping device using a compression or rotary die will be employed. While it may be suspected that the diamond-coated sheet might cause the stamping or cutting tools used to cut out the desired shapes for the pads to have unduly short lives, it has been found that this is not the case; apparently the relatively thin layer of small particulate diamond material does not cause undue wear of such tools.

Adhesive layer 16 can be contact cement or other waterproof adhesive means sufficiently strong to adhere pad 1 to lens lapping tool 2 during use and yet allowing eventual removal and replacement of the pad. Suitable adhesive layers include pressure sensitive adhesives such as double faced pressure sensitive tape.

Substrate layer 12 can be made of any metallic or conductive material to which a metal can be plated and which is sufficiently flexible to conform to curved surface 6 of lens lapping tool 2. Substrate layer 12 can have radially extending channels or perforations cut therein but must have sufficient strength for use as a lapping pad. If deficient in strength an additional layer of, for example, polyester or polypropylene can be laminated to under surface 20, i.e., between substrate layer 12 and adhesive layer 22. Suitable substrate metals include copper, aluminum and steel and alloys thereof. Suitable substrate sheets will generally have a thickness within the range of from about 1/1000 inch to 1/16 inch.

Suitable diamond particles are those having a size of from about 10 microns to about 100 microns. Diamond particles having a size of from about 20 to about 30 microns have been found especially suitable for use in the present invention. As shown in FIG. 4, the diamond particles 16 are not completely buried in metal matrix 18. It has been found that a bond level or burial depth wherein from about 20% to about 90% of each diamond particle is buried is satisfactory. Metallic matrix 18 can be any suitable metal plating material having sufficient bonding strength for use in the present invention. Suitable metallic matrixes include nickel, bronze, gold, or the like.

It will be apparent to those skilled in the art that the diamond-coated abrasive pads of the present invention are more expensive than conventional pads. However, the initial cost will be more than recovered during the long life of the pad as compared to a conventional pad.

The following example is offered to further illustrate the method of the present invention.

EXAMPLE

A sheet of copper having a thickness of 0.010 inch is cleaned with a commerical cleaner and then plated with a diamond particle containing metallic matrix by the following procedure. The sheet is submerged in a horizontal position in a nickel plating bath which comprises:

nickel sulfate: 260 grams per liter
nickel chloride: 34 grams per liter
boric acid: 32 grams per liter The pH of the bath is maintained at about 3 and its temperature at about 52° C. The sheet is subjected to a current density of about 20 amperes per square foot of sheet, the sheet being the cathode, while diamond particles of a size of from about 20 to 30 microns are uniformly distributed over its upper surface for about three minutes. The upper surface of the sheet is purged of all loose diamond material and then the diamond material is continuously plated for an additional 18 minutes at a current of 40 amperes per square foot of sheet. Then after purging all loose diamond from its upper surface the sheet is dried and then lens lapping pads having a shape similar to that of FIG. 2 are cut from the sheet by means of a compression die and applied to lens lapping tools with a contact cement.

The lens lapping pads are found to be capable of grinding or abrading many lens blanks without scratching and are found to exhibit a long life in service.

What is claimed is:

1. A method of making an abrasive pad for an ophthalmic lens lapping tool comprising first metal plating diamond particles to a substrate sheet and then cutting shapes from said sheet, said shapes being conformable to the surface of said lens lapping tool.

2. The method of claim 1 wherein said shapes have a plurality of radially extending channels.

3. The method of claim 1 wherein said substrate sheet is made of a conductive material selected from the group consisting of copper, aluminum steel, and alloys thereof.

4. The method of claim 1 wherein said metal plating is carried out by means of electroplating nickel.

5. The method of claim 1 wherein said diamond particles have a size of from about 10 to about 100 microns.

6. The method of claim 5 wherein said diamond particles have a size of from about 20 to about 30 microns.

7. The method of claim 1 wherein said diamond particles have a burial depth of from about 20% to about 90%.

8. The product made by the method of claim 1.

9. A method of making an abrasive pad for an ophthalmic lens lapping tool comprising the steps of first forming an abrasive sheet by bonding an abrasive amount of diamond particles onto a conductive substrate by metal plating, said particles having a burial depth of from about 20% to about 90% and then cutting shapes from said sheet, said shapes adapted to conform to a surface of a lens lapping tool.

10. The product made by the method of claim 9.

* * * * *